United States Patent [19]

Faller

[11] 4,355,755

[45] Oct. 26, 1982

[54] FOOD TRAY

[75] Inventor: Rudolph A. Faller, Edina, Minn.

[73] Assignee: Champion International Corporation, Stamford, Conn.

[21] Appl. No.: 182,855

[22] Filed: Sep. 2, 1980

[51] Int. Cl.[3] ..... B65D 1/34; B65D 1/46

[52] U.S. Cl. ..... 229/2.5 R; 229/3.1; 229/43; 220/366; 220/74

[58] Field of Search ..... 229/2.5 R, 43, 3.1; 220/366, 74, 359

[56] References Cited

U.S. PATENT DOCUMENTS

| | | | |
|---|---|---|---|
| 476,340 | 6/1892 | Wagandt | 229/2.5 X |
| 3,351,265 | 11/1967 | Miller | 229/43 |
| 3,530,917 | 9/1970 | Donovan | 229/2.5 X |
| 3,647,104 | 3/1972 | Goings | 229/2.5 X |
| 3,843,009 | 10/1974 | Emery | 229/2.5 X |
| 3,904,103 | 9/1975 | Chadbourne | 229/2.5 |
| 3,938,727 | 2/1976 | Andersson | 229/2.5 R |
| 4,026,457 | 5/1977 | Schubert | 229/43 X |
| 4,026,458 | 5/1977 | Morris et al. | 229/2.5 R X |

FOREIGN PATENT DOCUMENTS

| | | | |
|---|---|---|---|
| 563187 | 9/1958 | Canada | 229/2.5 |

*Primary Examiner*—Horace M. Culver

*Attorney, Agent, or Firm*—Evelyn M. Sommer; William W. Jones

[57] ABSTRACT

An improved tray particularly suited for packaging food is formed by drawing a unitary blank of paperboard and includes an outwardly extending flange along the upper edge of the tray to provide a face to which a plastic cover sheet is bonded. Arcuately shaped troughs are formed in the face of the flange at each corner of the tray and a plastic cover sheet for enclosing the top of the tray, after the tray is filled with food, is ultrasonically bonded to the arcuately shaped troughs at each corner with matching sonic sealing heads. The sonically vibrating heads divert foods accidentally spilled into the troughs during the filling process from the troughs thereby improving the bond between the film and the plastic surface of the tray. Heat is applied to the cover sheet at the flange after ultrasonic bonding to assure complete sealing of the cover sheet to the flange.

8 Claims, 7 Drawing Figures

Fig. 3.
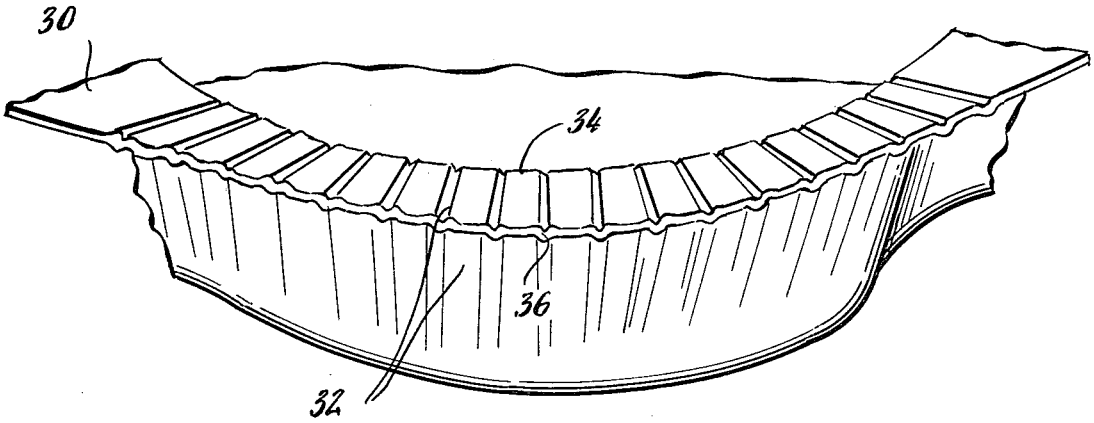
Fig. 4.
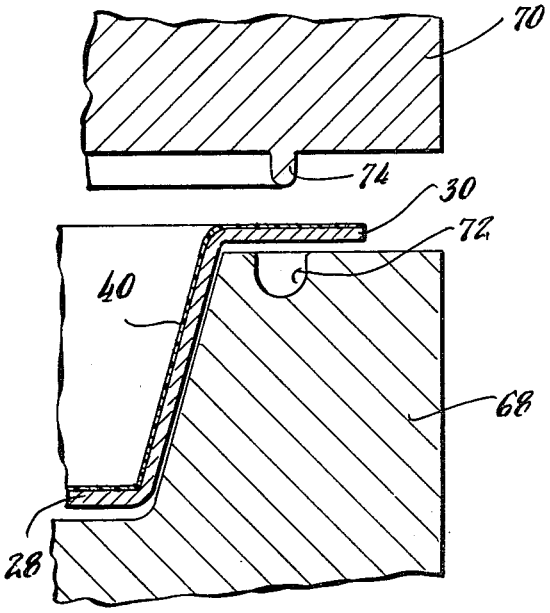
Fig. 5.
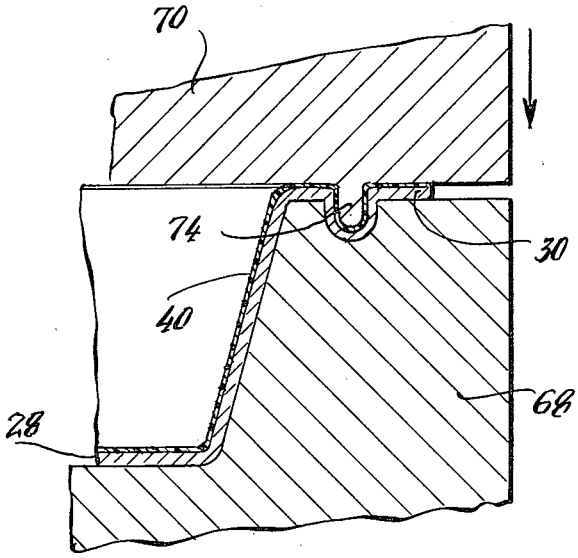
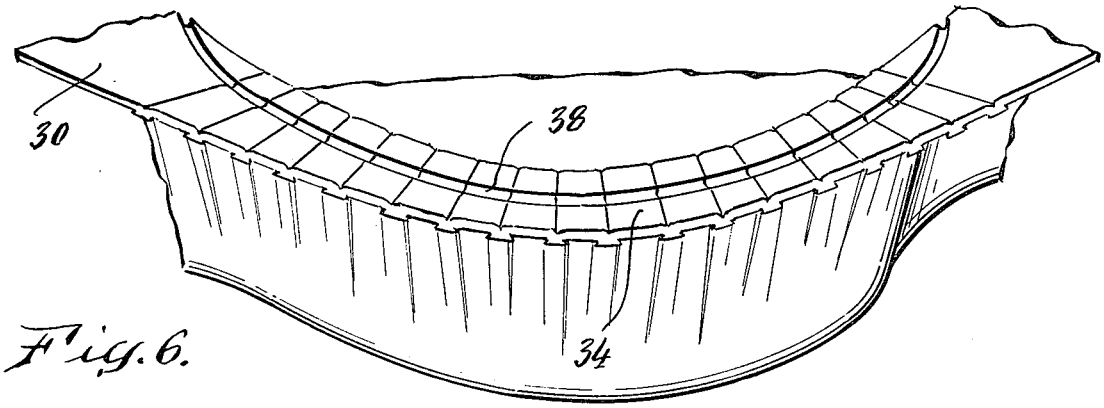
Fig. 6.

FOOD TRAY

TECHNICAL FIELD

The present invention relates to the packaging art and deals more particularly with an improved food tray and packaging process.

BACKGROUND AND BRIEF DESCRIPTION OF THE INVENTION

Numerous types of trays made from paperboard have been employed in the past for packaging food products. Some trays are formed from a unitary, paperboard blank using a drawing process. The tray may include an outwardly extending flange around the entire upper edge which provides the dual function of rigidifying the tray and providing a flat surface to which a plastic cover sheet may be bonded in order to enclose the top of the tray after the tray has been filled with food.

More recently, the depth of trays of the type described above has been increased in order to accommodate various types of food and increase the capacity thereof. Because these deeper trays are drawn from a single sheet of paperstock, it became necessary to prescore the blank at the corners thereof in order to produce evenly distributed folds in the paperboard at the corners of the tray during the drawing process. These folds reduce stress concentrations in the corners while the paperboard is being deformed during the drawing process and thereby eliminate potential tearing of the paperboard stock. The folds in the paperboard created by pre-scoring thereof are present in the side walls of the tray and extend into the flange. The folds created in the flange result in alternating ridges and depressions forming a ribbed effect in the flange at the corners of the tray. The ribbed surface of the flange at the corners of the tray creates difficulty in bonding and completely sealing a cover sheet around the entire perimeter of the flange. Incomplete sealing of the cover sheet to the flange may result in some loss of the product from the tray during shipping, handling and display and may cause degradation of the food product due to exposure thereof to the surrounding environment.

Another problem related to sealing of a cover sheet to prior art type trays involves the fact that during filling of the tray with food product, portions of the food product, whether liquid or solid, may splash onto the flange. Food product remaining on the flange contributes to incomplete or weak sealing of the cover sheet to the flange.

Accordingly, it is an object of the present invention to provide a deep-drawn paperboard tray having prescored corners forming ridges in the flange thereof which includes troughs debossed into the irregular flange areas at the corners of the tray to promote an improved bond through the use of ultrasonically vibrating tooling designed to match the shaped of the troughs, when sealing a cover sheet to the flange of the tray.

Still another object of the present invention is to provide a novel method of sealing the cover sheet to the tray.

These and further objects of the invention will become clear or made apparent during the course of the following description. In accordance with the present invention, an improved tray particularly suited for packing food is deep drawn from a unitary, pre-scored blank of paperboard and includes an outwardly extending flange along the upper edge of the tray to provide a face to which a plastic cover sheet is bonded. After the tray is formed, arcuately shaped troughs are formed in the face of the flange at each corner of the tray by die pressing thereof. Simultaneous with the forming of the troughs, ridges existing in the flange created by folds in the paperboard at the scorelines therein are flattened by die members to provide a smooth bonding surface on the flange. A plastic cover sheet for enclosing the top of the tray is ultrasonically bonded to the trough areas of the flange after the tray is filled with food. The ultrasonically vibrative tooling clears the trough areas of extraneous food and the troughs can divert some of those foods spilled in those areas during the filling process back into the interior of the tray. Heat is subsequently applied to the total flange after ultrasonic bonding thereof to assure complete sealing of the cover sheet to the flange.

DESCRIPTION OF THE DRAWINGS

In the drawings, which form an integral part of the specification and are to be read in conjunction therewith, and in which like reference numerals are employed to designate like parts on the various views:

FIG. 3 is an enlarged detailed perspective view of the exposed corner of the tray of FIG. 1, prior to forming troughs in the flange thereof;

FIG. 4 is a fragmentary, sectional view of the die assembly for forming the troughs, the male die member being shown in an elevated position;

FIG. 5 is a view similar to FIG. 4 but showing the male die member shifted to its lower position;

FIG. 6 is a view similar to FIG. 3 but showing the formation of a trough in the flange; and FIG. 7 is a flow sheet diagram illustrating the packaging process used to fill and seal the tray of FIG. 1.

DETAILED DESCRIPTION OF THE INVENTION

Figure 1:
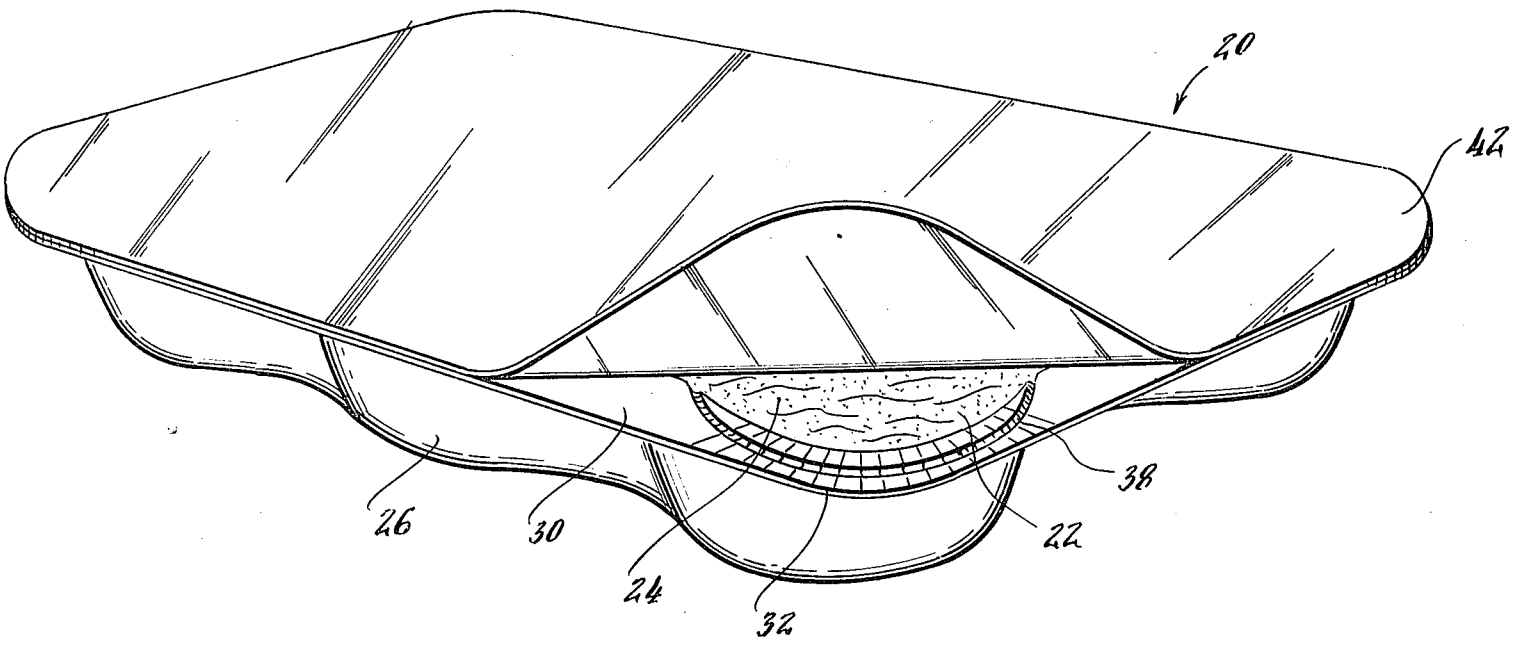
FIG. 1 is a perspective view of a tray forming part of the present invention, one corner of the tray cover sheet being peeled away to reveal food product packaged within the tray.
Figure 1:
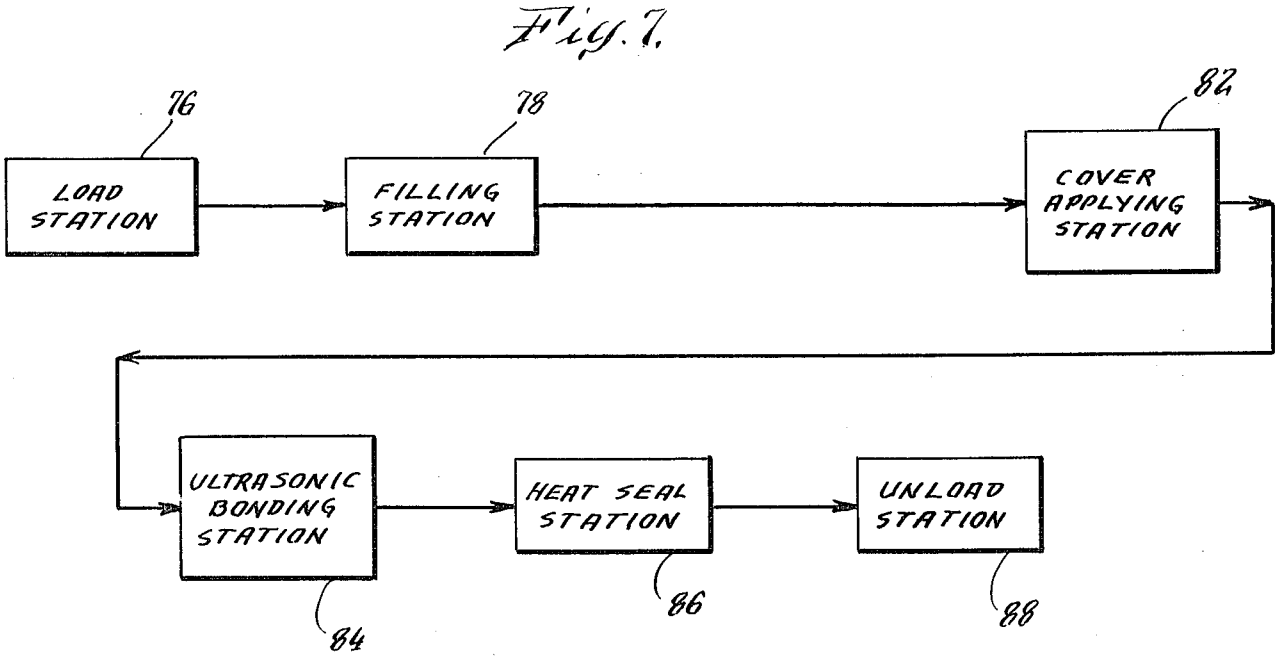

Referring now to the drawings, the present invention relates to an improved food tray, generally indicated in FIG. 1 by the numeral 20, and a packaging food process involving forming of the tray and filling and sealing the same with a food product 22. The tray 20 is formed from a unitary, one-piece paperboard blank (not shown) into a generally rectangular configuration by processing steps which will be discussed later. The particular tray 20 shown in the drawings includes a plurality of aligned, adjacent compartments 24 which are defined in part by serpentine sidewalls 26. Sidewalls 26 are formed integral with the bottom wall 28. The tray 20 further includes an outwardly extending, essentially horizontal flange 30 formed integral with the upper edges of the sidewalls 26, which extends completely around the perimeter of the tray 20.

The blank (not shown) from which tray 20 is formed includes a plurality of radially disposed score lines therein which produce radially extending, regularly spaced folds 32 in the flange 30 at the corners of the tray 20. Folds 32 are defined by upstanding ridges 34 and alternating depressions 36 which provide an uneven, ribbed effect in the flange 30 at the tray corners.

An arcuately shaped trough 38 is provided in the flange 30 at each corner of the tray 20. Each of the troughs 38 extends equidistantly on opposite sides of the corners of the tray 20. Intermediate stretches of each of the troughs 38 are disposed essentially equidistant between opposite lateral edges of the flange 30, and in the preferred form of the invention, the opposite extremities of each of the troughs 38 curve inwardly toward the interior of the tray 20 and communicate therewith. As best seen in FIGS. 1 and 6, the opposite extremities of each of the troughs 38 extend slightly beyond the outermost ridges 34 and depressions 36.

As will be discussed in more detail later, the ridges 34 are substantially compressed during manufacture of the tray 20 such that the surface of ridges 34 is essentially coplanar with upper face of the flange 30 between the corners of the tray.

The interior of the tray 20 and upper surfaces of the flange 30 includes a plastic layer 40 bonded thereto. Plastic layer 40 may comprise any film-forming polymeric material such as a polyamide, polyethylene, but in the preferred form consists of a polyester such as polyethylene terephthalate (PET) applied to the surface of the paperboard substrate. The plastic layer 40 is applied to the paperboard substrate by extrusion or lamination prior to forming the blank into the tray 20. In any event, the tray 20 further includes a cover sheet 42 bonded to the upper face of flange 30 in order to seal the food product 24 within the tray 20 from the surrounding environment. Cover 42 may be of a plastic material, and preferably comprises polyethylene terephthalate.

Figure 2:
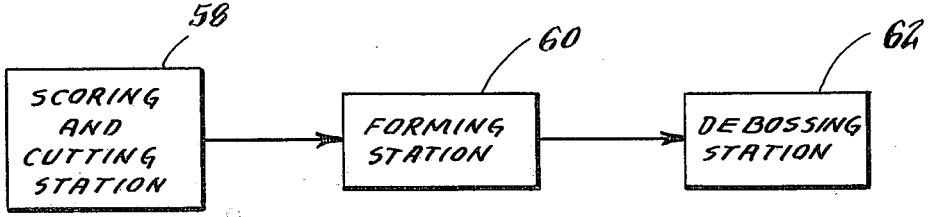
FIG. 2 is a flow sheet diagram illustrating the initial process of forming the tray of FIG. 1.

As shown in FIG. 2, the tray 20 is formed from the composite paperboard/plastic stock by successively feeding the stock to a scoring and cutting station 58, a forming station 60, and a debossing station 62. The scoring and cutting station 58 can include male and female die members which cut sections of the stock to provide a blank of a predetermined geometrical configuration, which, in the case of the tray 20 displayed in the drawings, is essentially rectangular in shape. Further, radially extending score lines are impressed into the blank at the corners thereof.

The scored and cut blank is then delivered to the forming station 60 which includes a male and female die, which are respectively configured to conform to the interior and exterior shape of the food tray 20. The female die must be heated to facilitate drawing of the blank. During forming of the food tray 20 at the station 60, folds 32 which create the ridges and depressions 34 and 36, are produced in the flange 30.

The next step in manufacturing the food tray 20 consists of delivering the formed food tray from the forming station 60 to a debossing station 62 which includes a lower, stationary female die 68 and an upper, vertically reciprocable male die 70. Female die 68 is generally similar in configuration to the female die in forming station 60, but further includes a C-shaped depression 72 on the upper edge of the corners thereof. The C-shaped depression 72 has an essentially semi-circular configuration, while the upper surfaces on opposite lateral sides of the depression 72 are essentially flat and extend parallel to the flange 30. The male die 70 is provided with a C-shaped rib or protrusion 74 which is adapted to be matingly received by the depression 72. The lower surface areas on opposite lateral sides of the protrusion 74 are essentially flat and extend parallel to the flange 30. The male die 70 is provided with a C-shaped rib or protrusion 74 which is adapted to be matingly received by the depression 72. The lower surface areas on opposite lateral sides of the protrusion 74 are essentially flat and extend parallel to the upper surfaces of female die 68.

The tray 20 is installed within the female die 68 at the debossing station 62. The male die 70 is then shifted vertically downwardly whereby the protrusion 74 of the male die 70 engages the flange 30 and forms the latter into the depression 72 to create the arcuately shaped trough 38. Simultaneously, the flat surface areas on opposite lateral sides of both the C-shaped depression and protrusion 72 and 74 respectively, compress the ridges 34, thereby substantially flattening the same a second time to produce an essentially smooth, flat surface around the entire face of the flange 30 at the tray corners.

With the tray 20 thusly formed in accordance with the preceding description, the tray 20 may be filled with food product and then closed in accordance with the packaging process which will now be discussed. The production packaging process is generally indicated in FIG. 7 and consists of a plurality of operating stations for performing a variety of operations in tandem. Empty trays 20 are individually deposited from a source thereof by an operator or a suitable mechanism at a loading station 76. The empty tray 20 is then fed to a filling station 78 where food product from a source is deposited into the tray. The filled tray is then fed to a cover-applying station 82 where a cover sheet 42 is placed over the flange 30 of tray 20. The filled and covered tray 20 is then delivered to an ultrasonic bonding station 84 where the corners of the cover sheet 42 are securely bonded and thereby sealed to the flange 30. The tray is then delivered to a heat seal station 86 where heat is applied to the entire periphery of the flange 30 in order to assure complete sealing of the cover sheet 42 to the flange 30. Finally, the filled and sealed tray 20 is fed to an unloading station 88.

The ultrasonic bonding station 84 includes ultrasonic bonding apparatus of a type commercially available such as that manufactured by the Branson Instruments, Inc. The ultrasonic bonding apparatus will typically include a power supply which delivers electrical energy at 20,000 Hertz to a plurality of applicator horns. Each horn is specially designed to have a tip provided with a cross-section approximately matching the corner trough area on the flange 30 of each tray 20. A plurality of horns are mounted for simultaneous vertical movement above the tray 20 and the tips move into and out of contact with the desired portions of the edges of the cover sheet 42 above the trough areas on the flange 30. The tips of the ultrasonic tooling pound the cover film 42 into the troughs 38 with so much energy, they expel extraneous food and cause a bond between the covering film 42 and the plastic lining at the trough areas.

The vibration set up in the troughs 38 of flange 30 also causes some accidentally deposited food particles remaining on the other areas of the upper face of the flange 30 to be displaced from the flanges and fall into the interior of the tray 20. The removal of residual food products from the upper faces of the flange 30 by virtue of the combination of the troughs 38 and vibration supplied by the ultrasonic horns results in a markedly superior seal being created for the cover sheet 42 at the trough areas 38.

From the foregoing it is apparent that the improved tray and packaging process of the present invention not only provide for the reliable accomplishment of the objects of the invention but do so in a particularly simple and effective manner. The instant invention is effective in overcoming a critical weakness in press form trays, namely the irregularity in the flange area in the four corners of the tray. The provision of the troughs and the use of the sonic sealing technique proposed by the applicant is effective to overcome this weakness. It is recognized, of course, that those skilled in the art may make various modifications or additions to the preferred embodiment chosen to illustrate the invention without departing from the spirit and scope of the present contribution to the art. Accordingly, it is to be understood that the protection sought and to be afforded hereby should be deemed to extend to the subject matter claimed and all equivalents thereof fairly within the scope of the invention.

What is claimed is:

1. A one-piece deep drawn paperboard food tray comprising:

(a) a bottom wall;

(b) means forming a side wall integral with said bottom wall and extending upwardly therefrom to form sides for said tray surrounding said bottom wall;

(c) a flange integral with said side wall and extending outwardly from a top edge of said side wall to form an upper planar sealing surface about the upper periphery of said tray;

(d) said flange including corner portions having a plurality of pleats formed therein, said pleats being flattened so as to present a planar upper sealing surface which is coplanar with the remainder of said upper sealing surface of said flange; and (e) recessed troughs formed in each of said corner portions of said flange, said troughs traversing said pleats with both sides of said troughs being bounded by said planar upper sealing surface formed by said flattened pleats.

2. The tray of claim 1 wherein at least one end of each of said troughs is open through said side wall of said tray.

3. The tray of claim 1, further comprising a plastic film cover member sonically bonded to at least said planar upper sealing surface formed by said flattened pleats.

4. The tray of claim 3, wherein said cover member is also heat sealed to said upper sealing surface of said flange to seal contents of said tray from ambient surroundings.

5. The tray of claim 3 wherein said cover member is sonically sealed down into said troughs.

6. A food tray assembly comprising:

(a) a deep drawn one-piece paperboard tray having a bottom wall and a side wall integral with said bottom wall and extending upwardly from side edges of said bottom wall to form sides for said tray surrounding said bottom wall;

(b) a flange integral with said side wall and extending outwardly from a top edge of said side wall to form an upper planar sealing surface about the upper periphery of said tray;

(c) said flange including corner portions having a plurality of pleats formed therein, said pleats being flattened so as to present a planar upper sealing surface which is coplanar with the remainder of said upper sealing surface of said flange;

(d) recessed troughs formed in each of said corner portions of said flange, said troughs traversing said pleats with both sides of said troughs being bounded by said planar upper sealing surface formed by said flattened pleats; and (e) a plastic film cover member sonically bonded to said planar upper sealing surface formed by said flattened pleats, and also being bonded to the remainder of said upper sealing surface of said flange to seal contents of said tray from ambient surroundings.

7. The tray assembly of claim 6, wherein at least one end of each of said troughs is open through said side wall of said tray.

8. The tray assembly of claim 6, wherein said cover member is sonically sealed down into said troughs.

* * * * *